US011305955B2

(12) United States Patent
Yokoya et al.

(10) Patent No.: US 11,305,955 B2
(45) Date of Patent: Apr. 19, 2022

(54) IMAGE FORMING APPARATUS

(71) Applicant: CANON KABUSHIKI KAISHA, Tokyo (JP)

(72) Inventors: Takashi Yokoya, Yoshikawa (JP); Koji Yumoto, Toride (JP); Riki Fukuhara, Funabashi (JP); Akihiro Kawakita, Abiko (JP); Yutaka Ando, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 16/715,996

(22) Filed: Dec. 16, 2019

(65) Prior Publication Data

US 2020/0189868 A1 Jun. 18, 2020

(30) Foreign Application Priority Data

Dec. 17, 2018 (JP) ..... JP2018-235756

(51) Int. Cl.
*B65H 7/12* (2006.01)
*B65H 7/20* (2006.01)

(52) U.S. Cl.
CPC ..... *B65H 7/125* (2013.01); *B65H 7/20* (2013.01); *B65H 2511/524* (2013.01); *B65H 2553/30* (2013.01)

(58) Field of Classification Search
CPC . B65H 7/12; B65H 7/125; B65H 7/20; B65H 2511/13; B65H 2511/524; B65H 2551/20; B65H 2553/30
See application file for complete search history.

(56) References Cited

U.S. PATENT DOCUMENTS

2006/0164456 A1* 7/2006 Yamagishi ..... B65H 7/125 347/16
2013/0069299 A1* 3/2013 Matsuoka ..... B65H 5/06 271/10.01
2017/0126914 A1* 5/2017 Koyanagi ..... H04N 1/00779
2019/0049892 A1 2/2019 Yokoya et al.
2019/0344987 A1* 11/2019 Osawa ..... B65H 7/125
2020/0071103 A1* 3/2020 Tachi ..... H04N 1/32667

FOREIGN PATENT DOCUMENTS

JP 2014-118273 A 6/2014

* cited by examiner

*Primary Examiner* — Prasad V Gokhale
(74) *Attorney, Agent, or Firm* — Venable LLP

(57) ABSTRACT

An image forming apparatus includes an image forming unit configured to form an image on a sheet being conveyed on a horizontal path and a double feed sensor configured to execute double feed detection processing of detecting a state in which a plurality of sheets being conveyed on the horizontal path are conveyed in a duplicate manner. The image forming apparatus includes a double feed detection function table, in which whether to enable or disable the double feed detection processing is set according to a type of a sheet. The image forming apparatus determines whether to execute the double feed detection processing at a time of image formation in accordance with sheet setting information including information on a characteristic of a sheet to be used for the image formation and setting information on whether to execute the double feed detection processing, and the double feed detection function table.

8 Claims, 7 Drawing Sheets

| MEDIUM | DOUBLE FEED DETECTION FUNCTION |
|---|---|
| PLAIN PAPER | ENABLED |
| RECYCLED PAPER | ENABLED |
| COATED PAPER | ENABLED |
| MATT COATED PAPER | ENABLED |
| EMBOSSED PAPER | ENABLED |
| VELLUM PAPER | DISABLED |
| OHP | DISABLED |
| LABEL | DISABLED |
| POSTCARD | DISABLED |

FIG. 8

IMAGE FORMING APPARATUS

BACKGROUND OF THE INVENTION

Field of the Invention

The present disclosure relates to an image forming apparatus configured to form an image on a sheet, such as a printer, a copying machine, or a multifunction peripheral.

Description of the Related Art

An image forming apparatus of Japanese Patent Application Laid-open No. 2014-118273 has a function of detecting double feed, in which a plurality of sheets are conveyed in a duplicate manner. In this image forming apparatus, a double feed detection function can be set to be enabled or disabled in a selective manner. An example of a sensor configured to detect double feed is a double feed sensor using ultrasonic waves. The double feed sensor using ultrasonic waves includes an emitter configured to emit ultrasonic waves and a receiver configured to receive ultrasonic waves. The ultrasonic wave output from the emitter is received by the receiver. Double feed of sheets is detected based on a result of detection by the double feed sensor, which indicates a strength of the ultrasonic waves received by the receiver.

A print-on-demand (POD) engine, for example, a commercial printing apparatus, is required to form an image not only on plain paper sheets, but also on various types of sheets such as an overhead projector (OHP) sheet or vellum paper. However, the double feed sensor sometimes fails to accurately detect double feed depending on the type of a sheet. This is because an attenuation rate at a time when ultrasonic waves are transmitted through a sheet exhibits a different characteristic depending on the type of the sheet. When the double feed detection function is enabled, and a sheet of the type for which double feed cannot be accurately detected is conveyed, an occurrence of double feed may be erroneously detected even though double feed has not occurred in actuality. When the double feed detection function is disabled, and double feed of sheets has occurred, an image may be formed on double-fed sheets, resulting in a decrease in usability for the user. The present disclosure has been made in view of the above-mentioned problem, and has a primary object to provide an image forming apparatus configured to appropriately determine whether to execute double feed detection for a plurality of types of sheets.

SUMMARY OF THE INVENTION

An image forming apparatus according to the present disclosure includes: an image forming unit configured to form an image on a sheet being conveyed on a conveyance path; a double feed sensor configured to execute double feed detection processing of detecting a state in which a plurality of sheets are conveyed in a duplicate manner; a storage configured to store, according to a type of a sheet, in advance setting of whether to enable or disable the double feed detection processing; a setting unit configured to set sheet setting information including characteristic information on a characteristic of a sheet to be used for image formation and double feed detection setting information on whether to execute the double feed detection processing, the double feed detection setting information including settings for: an automatic mode, in which whether to enable the double feed detection processing is determined based on the setting stored in the storage; an on mode, in which the double feed detection processing is enabled irrespective of the setting stored in the storage; and an off mode, in which the double feed detection processing is disabled irrespective of the setting stored in the storage; and a controller configured to determine whether to enable the double feed detection processing at a time of image formation based on a type of a sheet to be used for the image formation and on the double feed detection setting information corresponding to the type of the sheet.

Further features of the present invention will become apparent from the following description of exemplary embodiments (with reference to the attached drawings).

BRIEF DESCRIPTION OF THE DRAWINGS

FIG. 8 is an explanatory diagram of a double feed detection function table.

DESCRIPTION OF THE EMBODIMENTS

Now, an image forming apparatus according to at least one embodiment of the present disclosure is described with reference to the drawings.

Image Forming Apparatus

Figure 1:
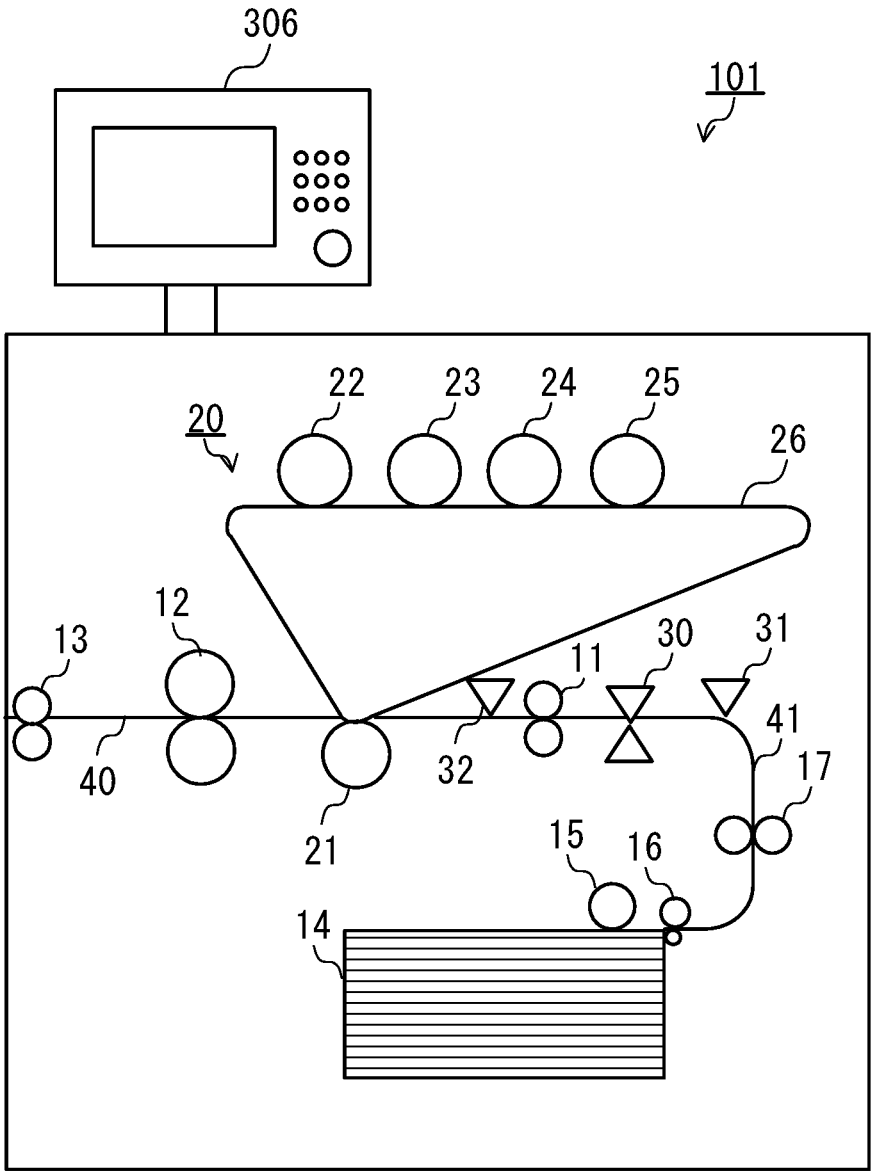
FIG. 1 is a configuration diagram of an image forming apparatus according to at least one embodiment of the present disclosure.

FIG. 1 is a configuration diagram of an image forming apparatus according to at least one embodiment of the present disclosure. An image forming apparatus 101 includes one or more sheet feeding trays 14 each configured to store a sheet on which an image is to be formed. The sheet is fed from the sheet feeding tray 14, and an image is formed on the sheet while the sheet is being conveyed on a conveyance path. The conveyance path includes a vertical path 41 and a horizontal path 40. The image forming apparatus 101 includes a pickup roller 15 and separation rollers 16 so that sheets are fed one by one in a separated manner from the sheet feeding tray 14 to the conveyance path (vertical path 41). The pickup roller 15 feeds sheets from the sheet feeding tray 14. The separation rollers 16 separate the sheets fed by the pickup roller 15 into individual sheets. The vertical path 41 includes vertical path rollers 17. The vertical path rollers 17 convey the sheet conveyed by the separation rollers 16 to the horizontal path 40.

The horizontal path 40 includes registration rollers 11. A conveyance sensor 31 and a double feed sensor 30 are provided upstream of the registration rollers 11 with respect to a conveyance direction of the sheet. The conveyance sensor 31 detects a conveyed sheet. The double feed sensor 30 is used for detecting whether a double feed state, in which a plurality of sheets are conveyed in a duplicate manner, has occurred. The double feed sensor 30 in at least one embodiment detects double feed by using ultrasonic waves.

The sheet is caused to abut against the stopped registration rollers 11 so that skew feeding of the sheet with respect to the conveyance direction of the sheet is corrected. A conveyance sensor 32 is provided downstream of the registration rollers 11 in the conveyance direction of the sheet. The conveyance sensor 32 detects a sheet conveyed by the registration rollers 11 on the horizontal path 40. The conveyance timing and conveyance speed of the sheet are adjusted depending on the result of detection by the conveyance sensor 31 and the conveyance sensor 32. On the horizontal path 40, a secondary transfer portion 21, a fixing device 12, and discharge rollers 13 are provided in order downstream of the conveyance sensor 32 in the conveyance direction of the sheet.

Image formation is executed by an image forming unit 20. The image forming unit 20 includes an intermediate transfer member 26 and photosensitive drums 22 to 25, on which toner images of different colors are to be formed. The toner images of respective colors formed on the photosensitive drums 22 to 25 are sequentially transferred onto the intermediate transfer member 26 in a superimposed manner. The toner images of respective colors are transferred in a superimposed manner, to thereby form a full-color toner image on the intermediate transfer member 26. The full-color toner image is conveyed to the secondary transfer portion 21 through rotation of the intermediate transfer member 26.

The registration rollers 11 convey the sheet, for which the skew feeding correction has been performed, to the secondary transfer portion 21 in synchronization with a timing at which the full-color toner image is conveyed to the secondary transfer portion 21. The secondary transfer portion 21 transfers the toner image formed on the intermediate transfer member 26 onto a sheet. The sheet onto which the toner image is transferred is conveyed from the secondary transfer portion 21 to the fixing device 12. The fixing device 12 fixes the toner image on the sheet by heating and pressuring the sheet onto which the toner image is transferred. The fixing device 12 conveys the sheet on which the toner image is fixed to the discharge rollers 13. The discharge rollers 13 discharge the sheet (deliverable) on which the toner image is fixed to the outside of the image forming apparatus 101.

The image forming apparatus 101 configured in this manner includes an operation device 306, which serves as a user interface. The operation device 306 is configured by combining an input device such as various kinds of key buttons and a touch panel and an output device such as a display and a speaker. The operation device 306 receives an operation of a user by the input device. The operation device 306 displays, on the display, information, for example, an operation state of the image forming apparatus 101, and outputs a warning sound, for example, from the speaker built in the operation device 306.

Controller

Figure 2:
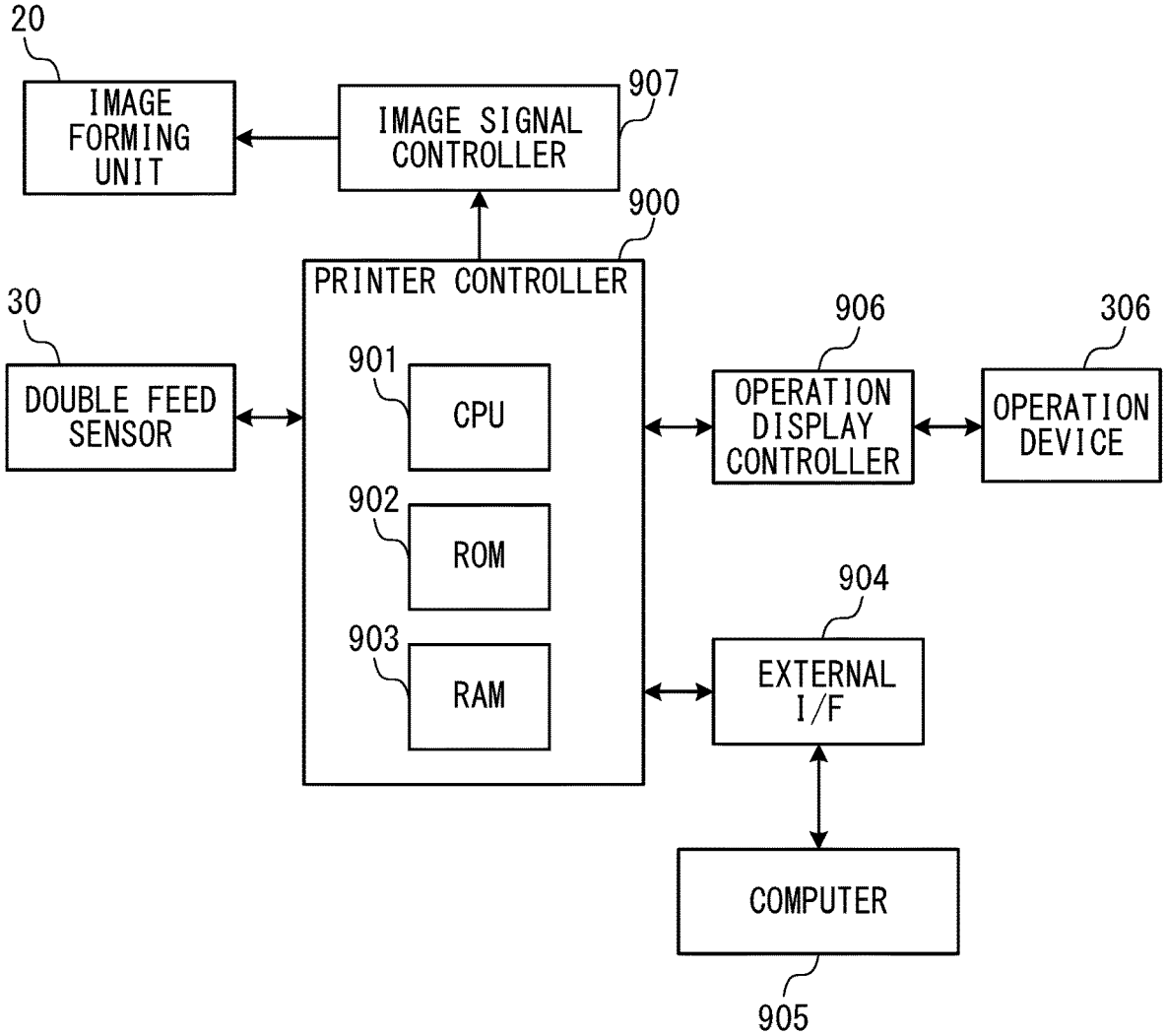
FIG. 2 is an exemplary configuration diagram of a controller.

FIG. 2 is an exemplary configuration diagram of a controller configured to control an operation of the image forming apparatus 101. The controller includes a printer controller 900. The double feed sensor 30, an image signal controller 907, an operation display controller 906, and an external interface (I/F) 904 are connected to the printer controller 900.

The printer controller 900 is an information processing device including a central processing unit (CPU) 901, a read only memory (ROM) 902, and a random access memory (RAM) 903. The CPU 901 executes a control program stored in the ROM 902 by using the RAM 903 as a work area. With this configuration, the CPU 901 controls the operation of the image forming apparatus 101.

The external I/F 904 is a communication interface arranged between the external I/F 904 and a computer 905 serving as an external device. The image forming apparatus 101 can transmit/receive data to/from the computer 905 via the external I/F 904. For example, the image forming apparatus 101 receives a job, for example, a printing job, from the computer 905 via the external I/F 904.

The image signal controller 907 generates a video signal by executing various kinds of processing for printing data included in the printing job acquired from the computer 905 via the external I/F 904. The image signal controller 907 transmits the generated video signal to the image forming unit 20. The image forming unit 20 executes image formation processing based on the video signal.

The operation display controller 906 controls communication between the printer controller 900 and the operation device 306. The operation display controller 906 inputs to the printer controller 900 an instruction which depends on an operation received by the operation device 306 through the input device, for example. The operation display controller 906 is controlled by the printer controller 900 to control display on the display of the operation device 306.

Double feed Detection

Figure 3:
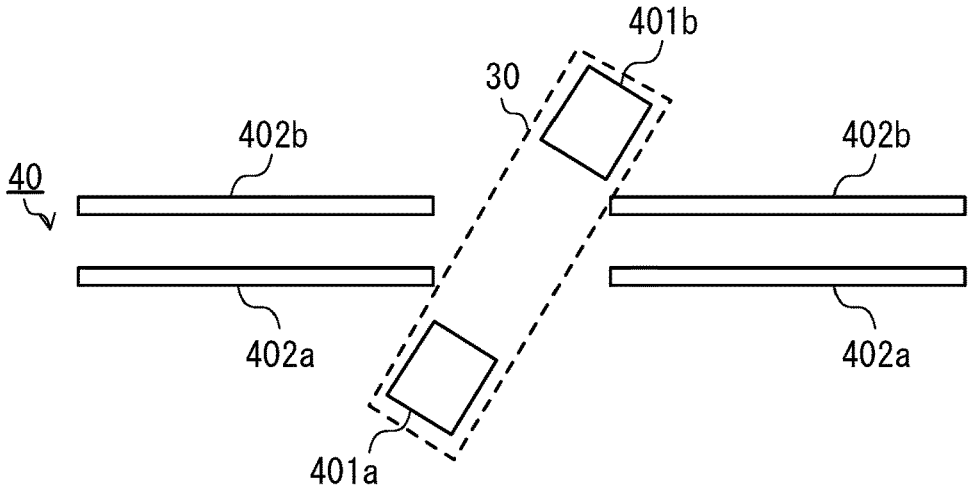
FIG. 3 is an explanatory diagram of a double feed sensor.

FIG. 3 is an explanatory diagram of the double feed sensor 30. The double feed sensor 30 detects double feed of sheets conveyed (i.e., two or more sheets are conveyed) between two guide plates 402*a* and 402*b* forming the conveyance path (horizontal path 40). The double feed sensor 30 in at least one embodiment is an ultrasonic sensor, and includes an emitter 401*a* and a receiver 401*b*. The receiver 401*b* is arranged opposite to the emitter 401*a* across the horizontal path 40.

The emitter 401*a* is connected to the printer controller 900 via, for example, a power amplification circuit (not shown). The printer controller 900 outputs a pulse signal having a predetermined frequency. The pulse signal is amplified by the power amplification circuit, and is input to the emitter 401*a*. The emitter 401*a* is driven by a pulse signal acquired from the power amplification circuit to emit ultrasonic waves.

The receiver 401*b* is connected to the printer controller 900 via, for example, an output amplification circuit and a rectifier smoothing circuit, which are not shown. The receiver 401*b* outputs a detection signal at a level that depends on the strength of ultrasonic waves received from the emitter 401*a*. The detection signal is amplified by the output amplification circuit, rectified by the rectifier smoothing circuit, and input to the CPU 901 of the printer controller 900. The CPU 901 detects double feed based on the detection signal. For example, the CPU 901 determines that double feed of sheets has occurred when a reception strength (reception level) of the ultrasonic waves indicated by the detection signal is equal to or smaller than a threshold value for determining double feed. The CPU 901, which has determined that double feed of sheets has occurred, notifies the user of an occurrence of double feed by the operation device 306 via the operation display controller 906. Such double feed detection processing is repeatedly executed during image formation processing.

Operation Device

Figure 4:
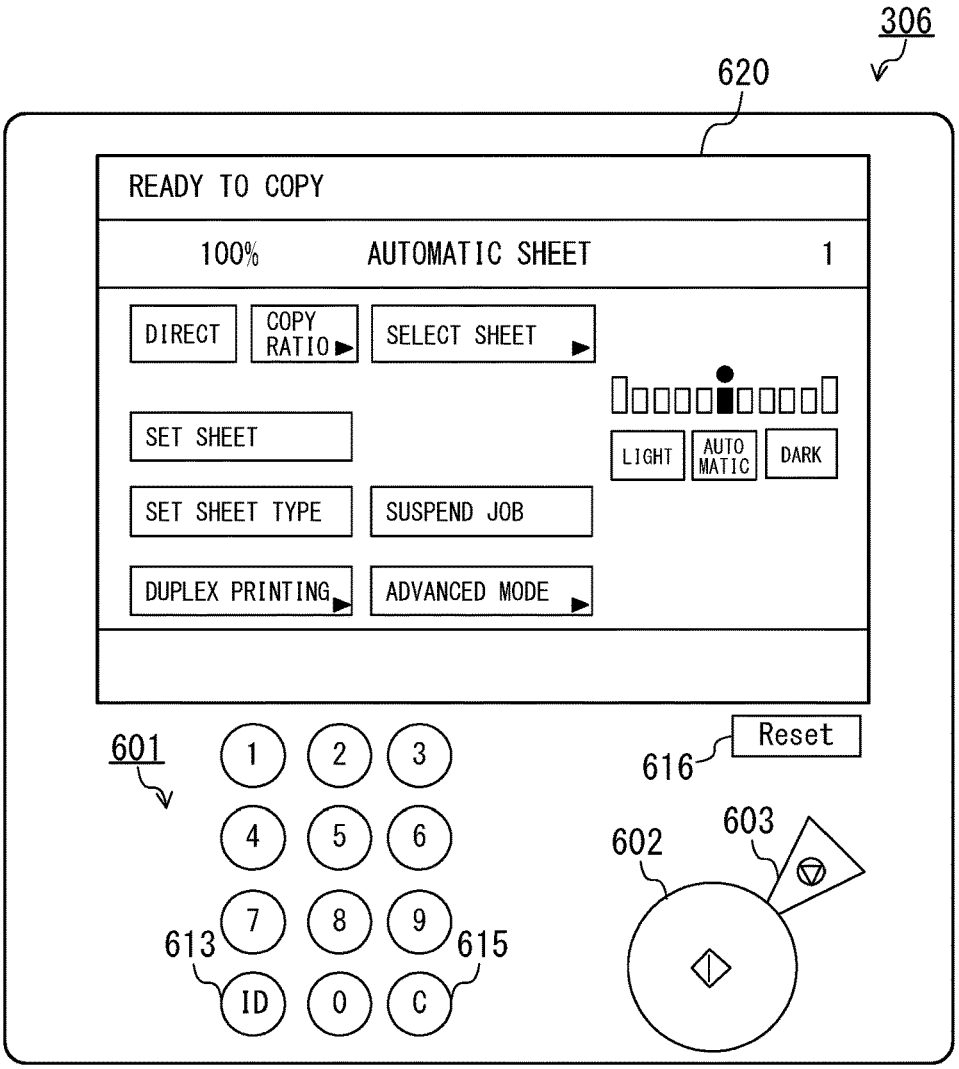
FIG. 4 is an explanatory diagram of an operation device.

FIG. 4 is an explanatory diagram of the operation device 306. The operation device 306 includes numeric keys 601 for executing, for example, a numeric setting, as an input device, a start key 602 for starting a job, a stop key 603 for interrupting a job, an ID key 613, a clear key 615, and a reset key 616. A display (display 620), which is an output device, is provided on the operation device 306 on the same surface as that of the input device. The display 620 serves as a touch panel, and software keys can be generated on the screen of the display 620.

The image forming apparatus 101 of at least one embodiment has a sheet setting function of enabling the setting of sheets, which is used frequently by the user for image formation processing, to be registered in advance as sheet type information. Such setting is performed through operation of the operation device 306 by the user. For example, when the user selects a button of "SET SHEET TYPE" on the initial screen illustrated in the display 620 of FIG. 4, a screen for setting the sheet type information is displayed on the display 620.

Sheet Type Information

Now, a description is given of processing of setting registration of information (sheet type information) on sheets to be used for image formation. FIG. 5A to FIG. 5F are explanatory diagrams of the processing of setting registration of the sheet type information. The registered sheet type information is stored into the RAM 903.

Figure 5A:
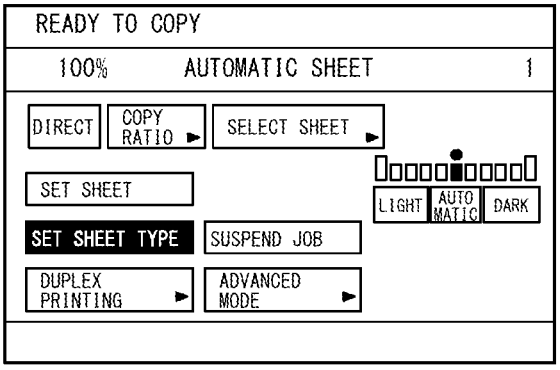
FIG. 5A, FIG. 5B, FIG. 5C, FIG. 5D, FIG. 5E, and FIG. 5F are explanatory diagrams of processing of setting registration of sheet type information.

FIG. 5A is an illustration of a state in which the user has selected a button of "SET SHEET TYPE" on the initial screen. When the button of "SET SHEET TYPE" is selected, the processing of setting registration of the sheet type information is started. When the button of "SET SHEET TYPE" is selected, the CPU 901 displays the sheet type setting screen illustrated in FIG. 5B on the display 620. On the sheet type setting screen, a list of pieces of sheet type information on sheets registered in the image forming apparatus 101 by the user in advance are displayed. When the sheet type information on sheets registered in advance are to be changed, the user selects a corresponding button of "USER-REGISTERED SHEET". When a user-registered sheet is to be newly created, the user presses a button of "CREATE".

Figure 5B:
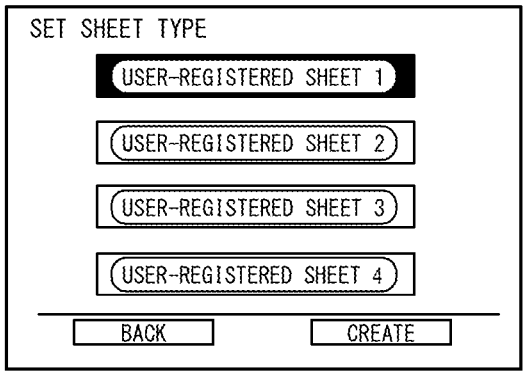
Figure 5C:
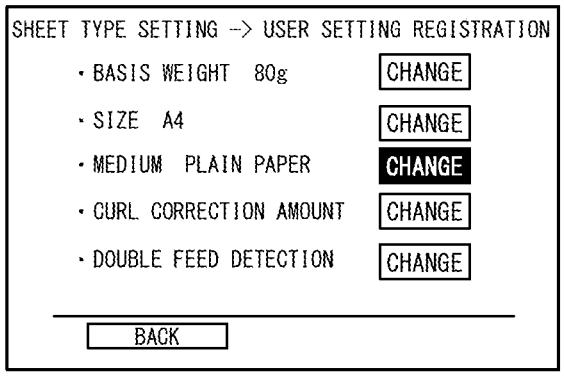
Figure 5D:
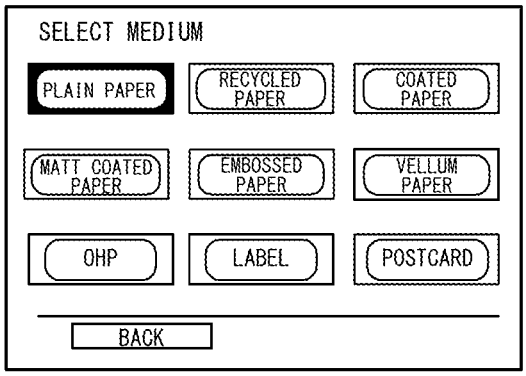

In FIG. 5B, the user selects a user-registered sheet displayed on the top of the sheet type setting screen, for example. When the user-registered sheet is selected, the CPU 901 displays a setting item list screen illustrated in FIG. 5C and FIG. 5E on the display 620. A list of items that can be set for a sheet is displayed on the setting item list screen. In the example of FIG. 5C, regarding the user-registered sheet selected in FIG. 5B, it is indicated that plain paper is set as the type (medium) of the sheet. Each item of the setting item list screen is changed by pressing a button of "CHANGE" of the corresponding item by the user. When a user-registered sheet is to be newly created, a default value is displayed on each item of the setting item list screen, and the user sets each item through use of the operation device 306.

When the medium is to be changed, the user presses a button of "CHANGE" of an item of "MEDIUM" (FIG. 5C). When the button of "CHANGE" is pressed, the CPU 901 displays on the display 620 a medium selection screen illustrated in FIG. 5D. A list of settable media is displayed on the medium selection screen. The user can select a medium on the medium selection screen. When the medium is selected, display of the display 620 returns to the setting item list screens of FIG. 5C and FIG. 5E.

Figure 5E:
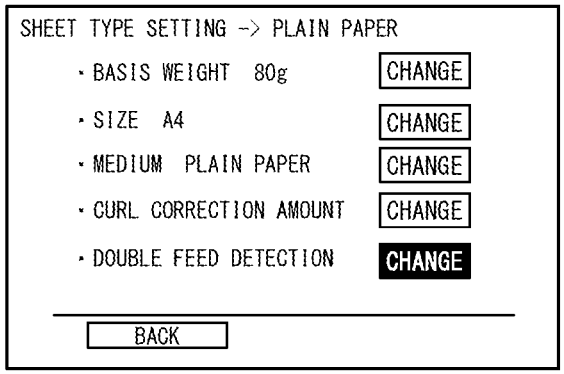
Figure 5F:
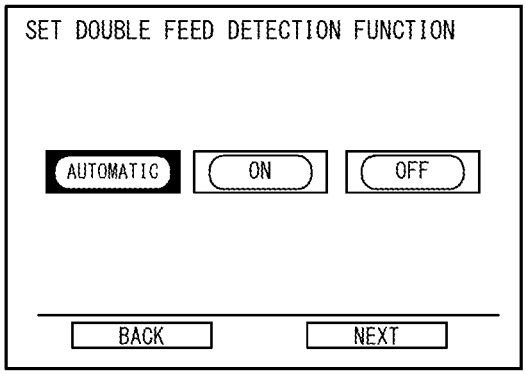

When the user desires to change the setting of the double feed detection function, the user presses a button of "CHANGE" of an item of "DOUBLE FEED DETECTION" on the setting item list screen (FIG. 5E). When the button of "CHANGE" is pressed, the CPU 901 displays on the display 620 the setting screen of the double feed detection function illustrated in FIG. 5F. On the setting screen of the double feed detection function, three buttons, namely, an "AUTOMATIC" button, an "ON" button, and an "OFF" button can be selected.

When the "AUTOMATIC" button is selected, the CPU 901 determines whether to enable or disable the double feed detection function based on data of the double feed detection function table. The double feed detection function table stores in advance data indicating whether the double feed detection function is to be enabled for each medium. This data is set in advance to indicate whether the double feed detection function is to be enabled based on whether the type (medium) of the sheet indicates a medium that enables accurate double feed detection. When "automatic" is set, the double feed detection function is set to an automatic mode. When the "ON" button is selected, the CPU 901 always enables the double feed detection function irrespective of details of data set in the double feed detection function table. When "ON" is set, the double feed detection function is set to an ON mode. When the "OFF" button is selected, the CPU 901 always disables the double feed detection function irrespective of details of data set in the double feed detection function table. When "OFF" is set, the double feed detection function is set to an OFF mode. Details of processing (processing of setting double feed detection function) of determining whether to enable or disable the double feed detection function are described later.

Sheet Setting Information

The user is required to register sheet setting information on the characteristic of a sheet stored in the sheet feeding tray 14 in the image forming apparatus 101 through use of the operation device 306. FIG. 6A to FIG. 6F are explanatory diagrams of the processing of registering the sheet setting information. This processing is executed when a sheet is stored in the sheet feeding tray 14, for example. The registered sheet setting information is stored in the RAM 903 according to identification information for identifying a sheet feeding tray. For example, when the image forming apparatus is an image forming apparatus in which a plurality of sheet feeding trays are provided, it is possible to identify sheet setting information on a sheet stored in each sheet feeding tray.

Figure 6A:
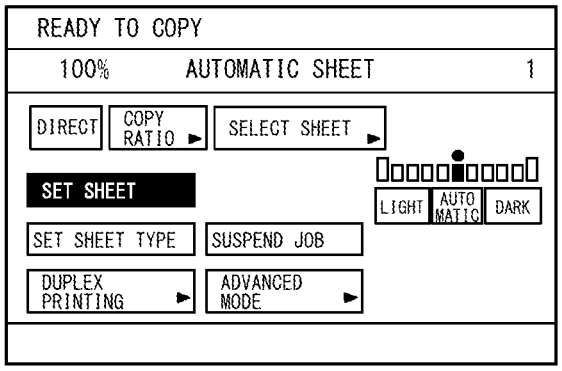
FIG. 6A, FIG. 6B, FIG. 6C, FIG. 6D, FIG. 6E, and FIG. 6F are explanatory diagrams of processing of registering sheet setting information.

FIG. 6A is an illustration of a state in which the user has selected a button of "SET SHEET" on the initial screen. When the button of "SET SHEET" is selected, the CPU 901 displays on the display 620 the sheet setting screen illustrated in FIG. 6B. On the sheet setting screen, the user selects whether to perform simple setting or perform setting based on the sheet type information on a registered sheet registered in advance by the user.

Figure 6B:
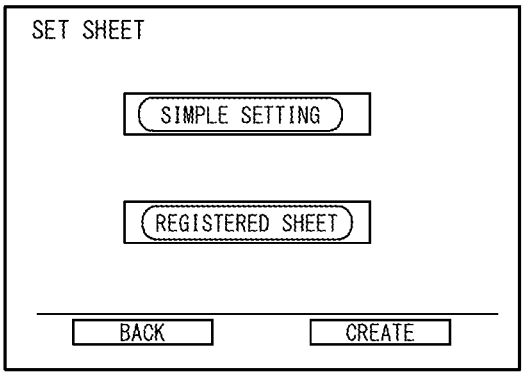
Figure 6C:
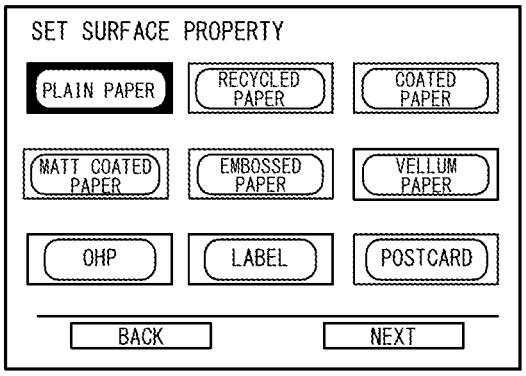
Figure 6D:
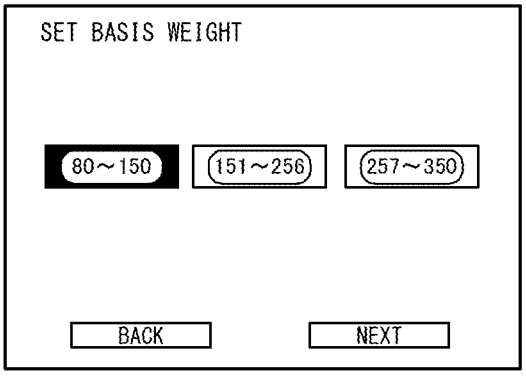
Figure 6E:
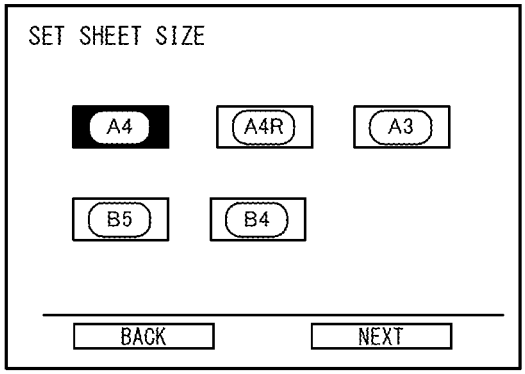

When a button of "SIMPLE SETTING" is selected, the sheet type information on a sheet is set according to the procedures described in FIG. 6C to FIG. 6E. When the sheet type information on a sheet is set with simple setting, the double feed detection function is set to "automatic", and it is determined whether double feed detection is to be executed based on the type (medium) of the sheet and the double feed detection function table.

When the button of "SIMPLE SETTING" is selected, the CPU 901 displays on the display 620 a screen for setting a surface property illustrated in FIG. 6C. The surface property (type) of a sheet is set on the screen. When the surface property of a sheet is set, the CPU 901 displays on the display 620 a screen for setting a basis weight of FIG. 6D. The basis weight of a sheet is set on the screen. When the basis weight is set, the CPU 901 displays on the display 620 a screen for setting a sheet size of FIG. 6E. The sheet size is set on this screen. When setting of the sheet size is finished, a series of simple setting of sheet setting information on sheets is finished.

Figure 6F:
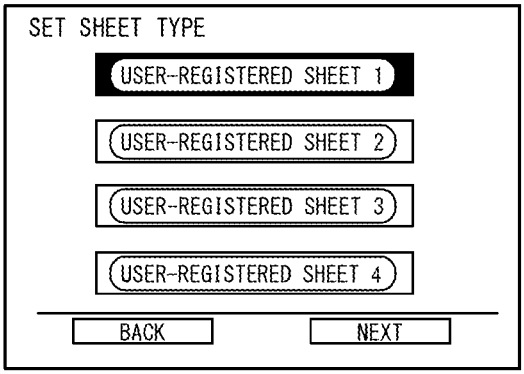

When a button of "REGISTERED SHEET" is selected on the screen of FIG. 6B, the CPU 901 displays on the display 620 the sheet type setting screen of FIG. 6F. On this screen, sheet type information registered by the user in the image forming apparatus 101 in advance is displayed. When the user has selected a type to be set from among a list of pieces of sheet type information, setting of sheet type information on a sheet is finished. When setting of sheet type information on a sheet is executed based on the sheet type information on a registered sheet, the double feed detection function is set based on details of setting of the double feed detection function of the sheet type information (setting illustrated in FIG. 5F).

As described in the above, a description has been given of the processing of registering the sheet type information on a sheet stored in the sheet feeding tray 14. However, when the image forming apparatus 101 includes a plurality of sheet feeding trays, the processing of registering the sheet type information on a sheet as described above is executed for each sheet feeding tray.

Processing of Setting Double feed Detection Function

Figure 7:
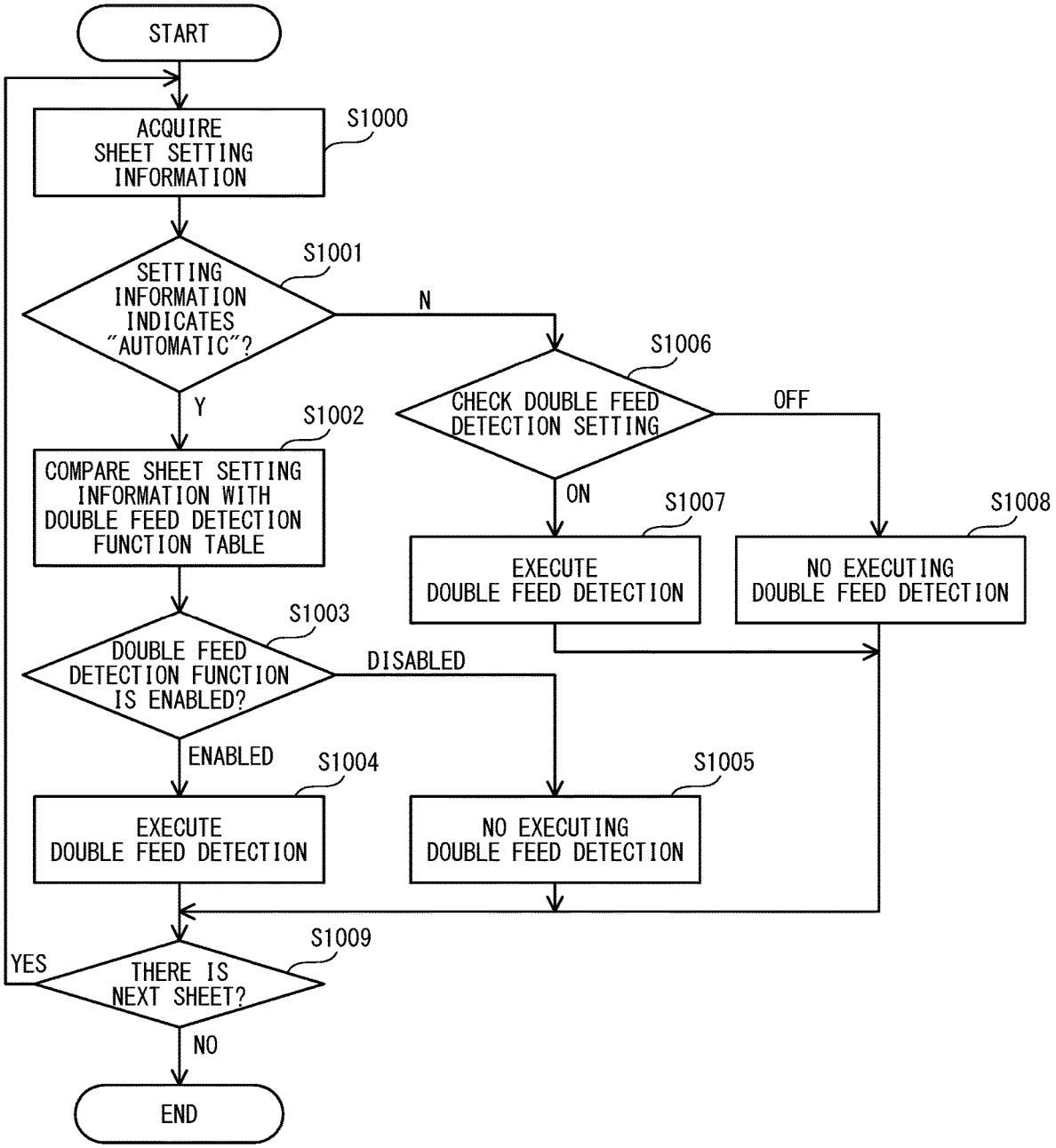
FIG. 7 is a flow chart for illustrating processing of setting a double feed detection function.

FIG. 7 is a flow chart for illustrating the processing of setting the double feed detection function. With this processing, it is determined whether double feed detection is to be executed during conveyance of a sheet stored in the sheet feeding tray 14.

When the start key 602 of the operation device 306 is pressed to give an instruction to start a job, the CPU 901 acquires sheet setting information corresponding to one sheet to be used for the job (Step S1000). The sheet setting information is information on a sheet to be used by a job in actuality. The CPU 901 acquires, from the RAM 903, sheet setting information corresponding to a sheet feeding tray specified by the job. The sheet setting information includes, for example, the basis weight, the size, the medium, and the setting information on double feed detection as described above. The CPU 901 determines whether the setting information on double feed detection included in the sheet setting information indicates "automatic" (Step S1001).

When the setting information on double feed detection indicates "automatic" (Step S1001: Y), the CPU 901 compares a medium included in the sheet setting information with the double feed detection function table shown in FIG. 8 (Step S1002). The double feed detection function table is stored in the RAM 903 in advance. The double feed detection function table stores in advance data indicating setting of whether the double feed detection function is to be enabled or disabled according to each medium. In the double feed detection function table, "ENABLED" is set to a medium that enables accurate double feed detection, whereas "DISABLED" is set to a medium that may result in erroneous detection of double feed.

As a result of comparison between the medium and the double feed detection function table, when the sheet type indicates a medium for which the double feed detection function is enabled (Step S1003: ENABLED), the CPU 901 determines that double feed detection is to be executed for a sheet at the time of image formation (Step S1004). When the sheet type indicates a medium for which the double feed detection function is disabled (Step S1003: DISABLED), the CPU 901 determines that double feed detection is not to be executed for a sheet at the time of image formation (Step S1005).

When the setting information on double feed detection included in the sheet setting information does not indicate "automatic" (Step S1001: N), the CPU 901 checks whether setting information on double feed detection is "ON" or "OFF" (Step S1006). When the setting information on double feed detection is "ON" (Step 51006: ON), the CPU 901 determines that double feed detection is to be executed for a sheet at the time of image formation (Step S1007). When the setting information on double feed detection is "OFF" (Step S1006: OFF), the CPU 901 determines that double feed detection is not to be executed for a sheet at the time of image formation (Step S1008). In the processing of Step S1006, the CPU 901 determines whether double feed detection is to be executed based only on the setting information on double feed detection included in the sheet setting information without referring to the double feed detection function table.

The CPU 901, which has determined whether to execute double feed detection, determines whether there is a next sheet (Step S1009). This determination is executed based on whether the job is to be continued. When there is a next sheet (Step 51009: YES), the CPU 901 repeatedly executes the processing of Step S1000 and subsequent processing until processing for the last sheet is finished. That is, it is determined whether double feed detection is to be executed for each sheet. When there is no next sheet (Step S1009: NO), the CPU 901 finishes the processing of setting the double feed detection function.

As described above, any one of "automatic", "ON", and "OFF" can be selected as the setting of whether double feed detection is to be executed, and the setting of whether to execute double feed detection for a plurality of media can be set. Therefore, it is possible to prevent erroneous detection of the occurrence of double feed which results from enabling the double feed detection function for a medium for which double feed cannot be detected accurately.

Specifically, when the setting information on double feed detection is set to "automatic", whether to allow execution of the double feed detection function is automatically determined for each medium (each type of sheet) based on the double feed detection function table. As a result, the user can use the double feed detection function without recognizing the characteristic (type) of a sheet. When the setting information on double feed detection is set to "ON" or "OFF", whether to allow execution of the double feed detection function is determined forcibly irrespective of a medium based on the setting information on double feed detection.

As a result, the double feed detection function is appropriately set for a sheet having a characteristic different from the characteristic of each medium assumed in the double feed detection function table. For example, even in a case of a medium (vellum or OHP) for which the double feed detection function is set, in the double feed detection function table, to be disabled, it may have a low possibility of erroneous detection of double feed depending on a sheet to be conveyed in actuality. In contrast, even in a case of a medium for which the double feed detection function is set, in the double feed detection function table, to be enabled, it may not have a low possibility of erroneous detection of double feed depending on a sheet to be conveyed in actuality. The user can forcibly enable or disable the double feed detection function depending on such a characteristic of a sheet to be conveyed in actuality.

In the processing of FIG. 7, the double feed detection function is determined to be enabled or disabled for all the sheets included in a job. The image forming apparatus 101 of at least one embodiment includes only one sheet feeding tray 14. The number of types of a sheet stored in one sheet feeding tray 14 is usually one. Thus, the determination of whether the double feed detection function is to be enabled or disabled may be performed for a first sheet in a job. In this case, the result of the determination for the first sheet may be applied to subsequent sheets as it is. Further, in this case, the CPU 901 is only required to execute the processing of FIG. 7 once.

When the image forming apparatus 101 includes a plurality of sheet feeding trays, different types of sheets may be stored for respective sheet feeding trays. In this case, different types of sheets may be mixed in the same job. In this case, the processing of FIG. 7 is executed for all the sheets included in the job. When a sheet feeding stage for feeding a next sheet is the same as that of a previous sheet, the enabled/disabled state of the double feed detection function for the previous sheet may be adopted as it is.

As described above, the image forming apparatus 101 of at least one embodiment can automatically execute double feed detection for a sheet having a low possibility of erroneous detection of double feed, and disable the double feed detection function for a sheet having a high possibility of erroneous detection of double feed. As a result, it is possible to suppress erroneous detection of double feed while at the same time preventing occurrence of a defective deliverable due to double feed. Further, in the image forming apparatus 101 of at least one embodiment, the double feed detection function can manually be set to be enabled or disabled on assumption that there are sheets of various characteristics, and hence the image forming apparatus 101 is usable for the user. In this manner, according to at least one embodiment of the present disclosure, it is possible to appropriately set whether to execute double feed detection for a plurality of types of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-235756, filed Dec. 17, 2018, which is hereby incorporated by reference herein in its entirety.

What is claimed is:

1. An image forming apparatus, comprising:

an image forming unit configured to form an image on a sheet being conveyed on a conveyance path;

a double feed sensor configured to execute double feed detection processing of detecting a state in which a plurality of sheets are conveyed in a duplicate manner;

a storage configured to store, according to a type of a sheet, in advance setting of whether to enable or disable the double feed detection processing;

a setting unit configured to set sheet setting information including characteristic information on a characteristic of a sheet to be used for image formation and double feed detection setting information on whether to execute the double feed detection processing, the double feed detection setting information including settings for:

an automatic mode, in which whether to enable the double feed detection processing is determined based on the setting stored in the storage;

an on mode, in which the double feed detection processing is enabled irrespective of the setting stored in the storage; and an off mode, in which the double feed detection processing is disabled irrespective of the setting stored in the storage; and a controller configured to determine whether to enable the double feed detection processing at a time of image formation based on a type of a sheet to be used for the image formation and on the double feed detection setting information corresponding to the type of the sheet.

2. The image forming apparatus according to claim 1, wherein the controller is further configured to:

determine, when the double feed detection setting information corresponding to the type of the sheet to be used for the image formation is set to the automatic mode, whether to enable the double feed detection processing at the time of the image formation based on the characteristic information on the sheet and on the setting stored in the storage;

determine, when the double feed detection setting information corresponding to the sheet is set to the on mode, that the double feed detection processing is enabled at the time of the image formation irrespective of the double feed detection setting information stored in the storage; and determine, when the double feed detection setting information corresponding to the sheet is set to the off mode, that the double feed detection processing is disabled at the time of the image formation irrespective of the double feed detection setting information stored in the storage.

3. The image forming apparatus according to claim 1, further comprising a tray configured to store the sheet, wherein the sheet setting information is registered by the setting unit in a case in which the sheet is stored in the tray.

4. The image forming apparatus according to claim 3, further comprising a plurality of trays, wherein the sheet setting information is registered in association with identification information for identifying each of the plurality of trays by the setting unit, and wherein, in a case in which an instruction to form an image is input, the controller acquires the sheet setting information which corresponds to identification information for identifying a tray corresponding to the instruction.

5. The image forming apparatus according to claim 3, wherein the setting unit is configured to register sheet type information on a sheet, and wherein the setting unit is configured to register the sheet type information selected by a user as the sheet setting information.

6. The image forming apparatus according to claim 5, wherein the setting unit is configured to be able to change the double feed detection setting information which corresponds to the registered sheet type information.

7. The image forming apparatus according to claim 1, further comprising at least one tray configured to store the sheet, wherein, in a case in which only one tray is provided and an instruction to form an image is input, the controller determines whether to execute the double feed detection processing for a first sheet, and in a case in which the double feed detection processing is determined to be enabled for the first sheet, the double feed detection processing is also determined to be enabled for subsequent sheets subsequent to the first sheet, and in a case in which the double feed detection processing is determined not to be enabled for the first sheet, the double feed detection processing is also determined not to be enabled for the subsequent sheets subsequent to the first sheet.

8. The image forming apparatus according to claim 1, wherein the double feed detection sensor includes:

an emitter configured to emit ultrasonic waves; and a receiver configured to receive the ultrasonic waves emitted by the emitter, and wherein the double feed detection sensor is configured to output, as a detection result, a detection signal at a reception level that depends on a strength of the ultrasonic waves received by the receiver.

* * * * *